United States Patent [19]

Blair

[11] 4,212,698

[45] Jul. 15, 1980

[54] APPARATUS FOR SETTING FABRIC LOOPS

[76] Inventor: Thomas O. Blair, 8026 SE. Powell Blvd., Portland, Oreg. 97206

[21] Appl. No.: 902,893

[22] Filed: May 4, 1978

[51] Int. Cl.[2] ..... A41H 1/00; B23Q 3/15; D05B 35/12; G01B 5/16

[52] U.S. Cl. ..... 156/378; 2/265; 2/266; 24/202.1; 33/2 R; 33/11; 33/DIG. 1; 73/159; 112/66; 112/121.15; 112/264.1; 156/64; 156/93; 156/579; 269/54; 269/54.4; 269/308

[58] Field of Search ..... 2/96, 128, 265, 266; 24/202, 202.1; 29/721; 33/2 R, 11, DIG. 1; 112/65, 66, 121.15, 264.1; 156/378, 579, 598, 64, 93, 202; 269/53, 54, 54.1, 54.4, 54.5, 307, 308; 428/99, 900; 73/159

[56] References Cited

U.S. PATENT DOCUMENTS

| | | | |
|---|---|---|---|
| 1,949,262 | 2/1934 | Stromelly | 269/54.5 |
| 2,114,271 | 4/1938 | Sweeney | 428/99 |
| 2,378,423 | 6/1945 | Menchaca | 269/54.5 |
| 2,955,820 | 10/1960 | Berg | 269/54 |
| 3,208,420 | 9/1965 | Waldes | 2/265 X |
| 3,401,459 | 9/1968 | Gomory | 33/2 R |
| 3,536,555 | 10/1970 | Thompson | 269/53 X |
| 3,794,554 | 2/1974 | Caring | 33/2 R X |
| 3,936,923 | 2/1976 | Cantor | 269/54.5 X |
| 3,949,629 | 4/1976 | Johnson | 428/900 X |

*Primary Examiner*—John T. Goolkasian
*Assistant Examiner*—Robert A. Dawson
*Attorney, Agent, or Firm*—Oliver D. Olson

[57] ABSTRACT

A laterally elongated plate is provided with anchors in a transversely elongated tape support area of the plate by which to secure the opposite ends of a length of pressure sensitive adhesive tape extended across the tape support area, with the adhesive side of the tape facing upward. A stitch indicator line is provided on the plate inwardly of and parallel to the tape support area to indicate an ultimate stitching line, and loop size guide lines also are provided on the plate spaced inwardly from and parallel to the stitch indicator line to orient cloth loop material according to the size of loops desired to be formed. Laterally spaced markings are provided on the plate adjacent the tape support area to aid in spacing loop units desired distances apart. A tool for supporting everted fabric loop material in looped form for application to the adhesive tape on the plate comprises a pair of wire rods secured to the terminal ends of a U-shaped handle of resilient material, the rods extending forwardly from the handle perpendicular to the plane of the handle.

12 Claims, 10 Drawing Figures

APPARATUS FOR SETTING FABRIC LOOPS

BACKGROUND OF THE INVENTION

This invention relates to the making of fabric garments, and more particularly to the attachment, during the making of a garment, of fabric loops intended to serve as button loops or as decorations for the garment.

It has been the general practice heretofore to provide button and decorative loops for a garment by hand folding short lengths of everted fabric loop material, generally known as "spaghetti strap", to form loops of visually desired size, and adhering the folded loops at spaced intervals to the adhesive side of a length of pressure sensitive adhesive tape. The tape with adhered loops then is inverted and placed adjacent an edge of a sheet of garment material with the loops facing inward of said edge. Downward pressure is applied to the adhesive tape to bond it to the underlying garment material. The assembly then is overlaid with another sheet of garment material and the composite assembly is sewed together along a stitching line defined by the points at which the folded loops are to be secured to the garment material. The top and bottom sheets of garment fabric then are folded back over the line of stitching to expose the spaced loops which projects from between the fabric sheets.

The foregoing procedure heretofore has been accomplished manually and by eye estimations of spacings, loop sizes and alignments. Accordingly, the procedure heretofore has been time consuming and frustrating and the results have been characterized by the production of loops of irregular sizes and irregular spacings between them.

SUMMARY OF THE INVENTION

In its basic concept, this invention provides apparatus by which to produce a plurality of button or decorative loops of uniform size and uniform spacings between them, preliminary to attachment to garment fabric.

It is by virtue of the foregoing basic concept that the principal objective of this invention is achieved; namely, to overcome the aforementioned disadvantages and limitations of prior procedures for forming fabric loops.

Another important object of this invention is the provision of apparatus of the class described which enables the production of fabric loops of a wide variety of shapes and sizes and a wide variety of spacings between them.

A further object of this invention is the provision of apparatus of the class described which is of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 1:
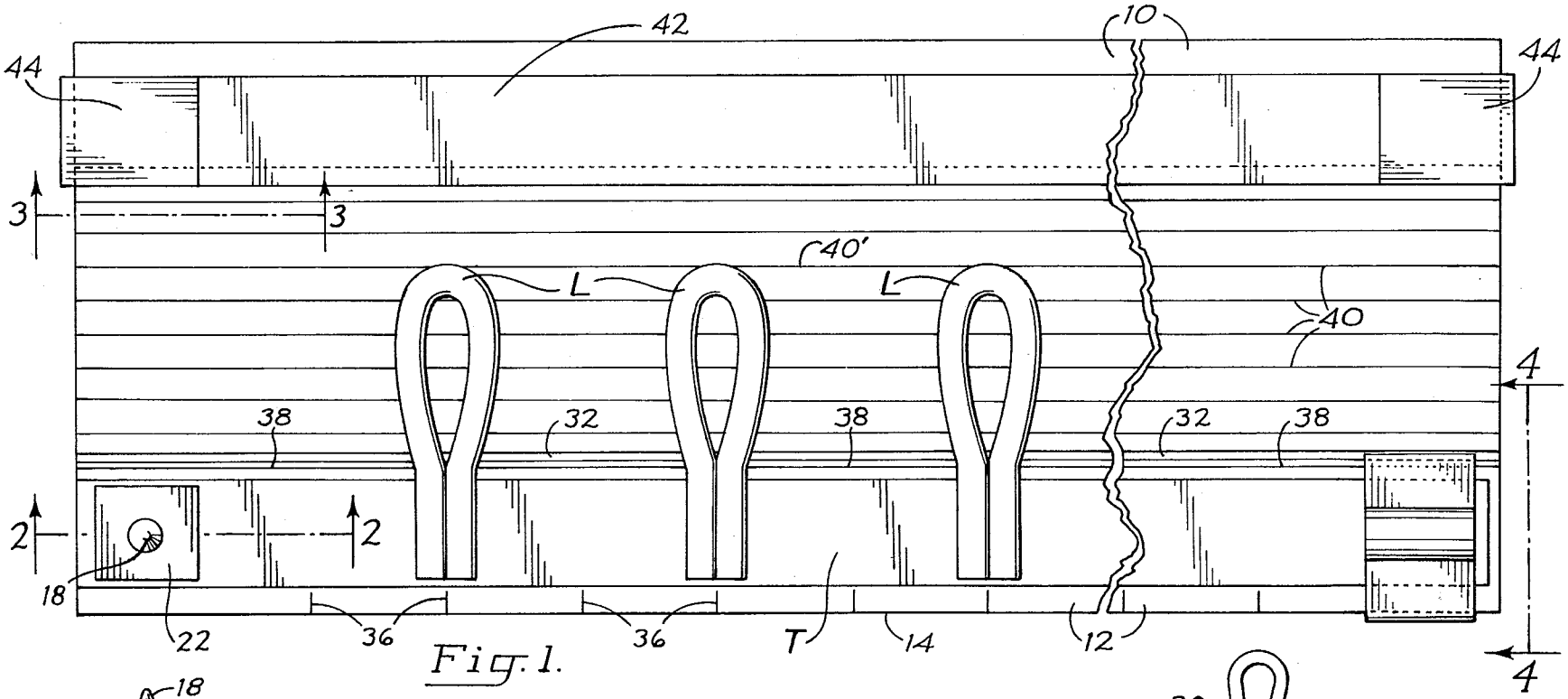
FIG. 1 is a foreshortened plan view of apparatus for setting fabric loops, embodying the features of this invention.
Figure 4:
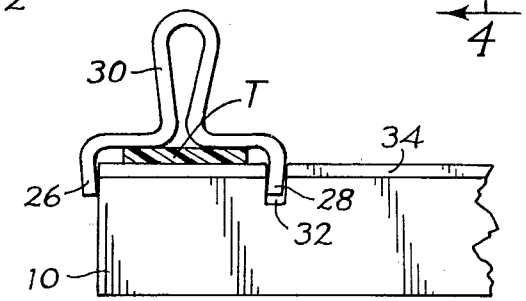
FIG. 4 is a fragmentary end elevation as viewed in the direction of the arrows 4—4 in FIG. 1.

Referring primarily to FIG. 1 of the drawings, there is illustrated in foreshortened plan view a laterally elongated, substantially rigid plate 10 of wood, plastic, metal, or other suitable material. Although the size of the plate may be varied over wide limits, as desired, a conveniently workable size is about 14" long and 3" wide.

The area 12 of the plate adjacent the front edge 14, i.e. the bottom edge in FIG. 1, provides a support area for a length of pressure sensitive adhesive tape T.

Since the adhesive surface of the tape is required to face upward, means is provided for anchoring the opposite ends of the tape in position on the support area. In the embodiment illustrated, one of the end anchors is provided by an upstanding post 16 having a pointed upper end 18 and a sharpened bottom end portion 20 imbedded in the plate 10. The post is located on the plate at one end, the left end as illustrated, of the tape support area 12.

An anchor block 22 is provided with a central opening 24 dimensioned to receive the post 16 freely therethrough. The associated end of a length of pressure sensitive adhesive tape T to be extended across the tape support area 12 of the plate, is bonded to the underside of the block, by means of the upwardly facing adhesive side of the tape, after which the block is installed upon the post. In so doing, it will be understood that the pointed upper end 18 of the post serves to penetrate the area of the adhesive tape underlying and registering with the central opening 24 in the block.

An advantageous feature of the apertured anchor block 22 is its ability to rotate relative to the post 16. Accordingly, with a length of adhesive tape secured at one end to the block and the latter mounted on the post, the opposite end of the tape may be swung arcuately to align the tape accurately with the tape support area 12.

The anchor block may be a simple washer. In the preferred form, the post 16 is made of magnetic metal and the anchor block 22 is provided in the form of a permanent magnet. The mutual attraction between the block and post thus insures against inadvertent dislodgment of the block and the attached adhesive tape from its anchored position. Additionally, the magnet block is retained on the post during storage of the apparatus.

Since the length of adhesive tape to be extended across the tape support area 12 of the plate may be varied, as dictated by the length of a garment area to be provided with button or decorative loops, the anchor for the end of the tape opposite the block 22 is arranged to be located at various positions along the lateral length of the support area. In the embodiment illustrated, this anchor is provided in the form of a resilient clip having laterally spaced terminal ends 26 and 28 joined by an intermediate resilient handle section 30. One terminal end 26 of the clip is arranged to engage the front edge 14 of the plate and the opposite terminal end 28 is adapted to engage an edge of a groove 32 formed in the upper surface of the plate rearwardly of and parallel to the tape support area 12. The bottom surface of the intermediate portion of the clip thus bears downward on the adhesive tape, to secure the latter in position on the tape support area.

Alternatively, the terminal end 28, of the clip may be extended to engage the rear edge of the base 10, thereby eliminating the need for groove 32.

It will be appreciated, of course, that the anchors for the opposite ends of the adhesive tape both may be of the anchor block 22 type or of the clip 26, 28 type. The arrangement illustrated is preferred, however, for the advantages described.

The upper surface of the plate 10 is provided with a number of appropriate markings which aid in the formation of bottom or decorative loops of predetermined size and in their location at desired spaced intervals along the tape. Although the various markings may be applied directly to the upper surface of the plate, they are shown in the drawing applied indirectly to the upper surface of the plate, by applying them to a sheet 34 of paper or other suitable material overlying and bonded to the upper surface of the plate.

Thus, a plurality of uniformly spaced marks 36 are provided across the front of the plate, to aid in achieving uniform spacing between a plurality of loops L on the adhesive tape. As illustrated, these markings are located immediately adjacent the front edge 14 of the plate, forwardly of the position of a length of adhesive tape T supported on the plate. Of course, since such pressure sensitive adhesive tape ordinarily is transparent, the markings may be located to underlie the tape.

Another marking on the plate is a line 38 located immediately adjacent and rearwardly of the tape support area 12 and extending parallel thereto. This line is a stitch indicator line which defines the ultimate line along which a line of thread stitching is to be made to secure the fabric loops to the garment fabric. If desired, this line may be provided by the groove 32 for the clip, in which case the groove is extended substantially entirely across the plate, as illustrated.

Rearwardly of the stitching indicator line 38 are a plurality of loop size indicator lines 40 which extend parallel to the stitching indicator line and are spaced apart rearwardly thereof, preferably at uniform intervals of about $\frac{1}{8}$ inch. Thus, in the illustration of FIG. 1, each of the loops L is shown to define an inner, elongated button opening at $\frac{5}{8}$ inch, extending rearwardly from the point where the loop material registers with the stitching line 38 to the closed end of the loop.

Figure 3:
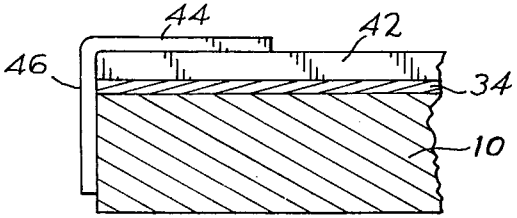
FIG. 3 is a fragmentary sectional view taken on the line 3—3 in FIG. 1.
Figure 2:
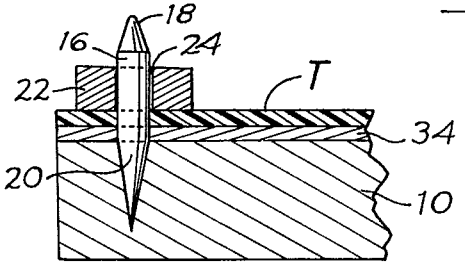
FIG. 2 is a fragmentary sectional view taken on the line 2—2 in FIG. 1.
Figure 5A:
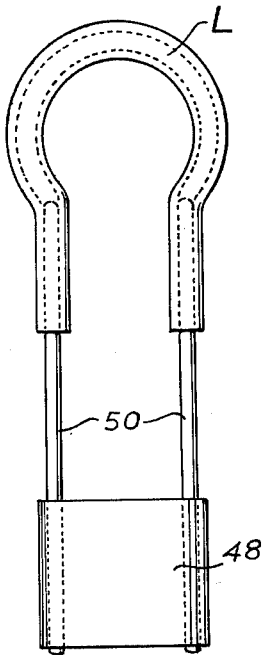
FIGS. 5*a* and 5*b* are plan views of a tool for holding fabric loop forming material, FIG. 5*a* showing the tool in relaxed condition preliminary to the forming of a botton loop of the material, and FIG. 5*b* showing the tool contracted to close the button loop material preliminary to adhering it to the adhesive side of a length of pressure sensitive adhesive.
Figure 5B:
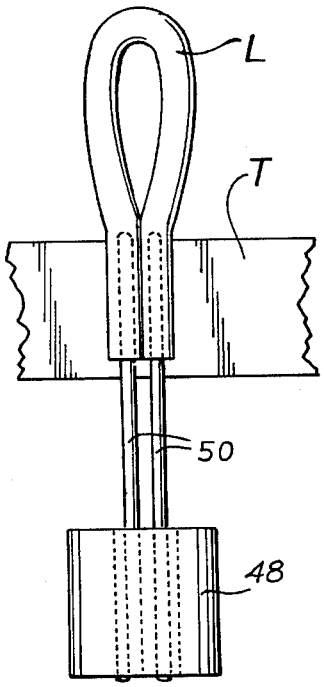
Figure 7:
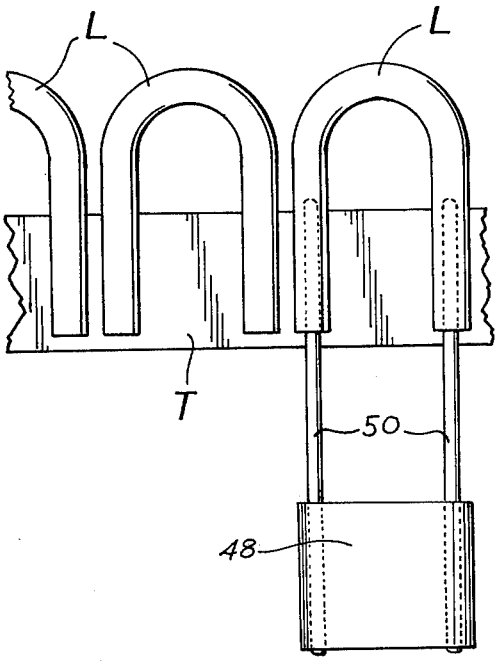
FIG. 7 is a fragmentary plan view, similar to FIG. 5*b*, illustrating the tool of FIG. 5*a* in relaxed condition supporting decorative loop material preliminary to adhering it to the adhesive side of a length of pressure sensitive adhesive tape.
Figure 6A:
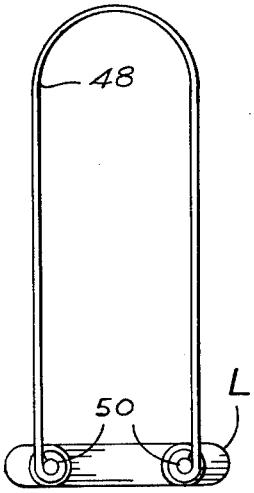
FIGS. 6*a* and 6*b* are fragmentary vertical elevations as viewed from the bottom in FIGS. 5*a* and 5*b*, respectively.
Figure 6B:
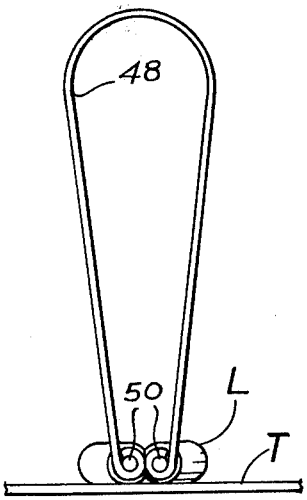

To assist the operator in the use of the loop size indicator lines, and to insure against inadvertent errors, a straight edge member may be provided for adjustment to the desired loop size indicator line 40 to serve as an abutment for the rearward end of the loop material L. Such a straight edge is illustrated in FIGS. 1 and 3. The elongated straight edge bar 42 is provided at each of its opposite ends with a resilient clip in the form of a right angle member the upper portion 44 of which is secured to the straight edge bar and the angular end portion 46 of which projects downward for frictional gripping of the lateral side of the plate 10.

Thus, with reference to FIG. 1, if it is desired to use the straight edge, it may be moved forward to align its front edge with the loop size indicator line 40' with which the rearward ends of the loops L are shown to be aligned.

Means also is provided for holding each length of everted fabric loop material L in loop form and facilitating its application to the pressure sensitive adhesive tape T. Referring to FIGS. 5–8 of the drawings, such means comprises a tool which includes a resilient handle mounting a pair of elongated wire rods projecting forwardly from the handle in parallel relation to each other for insertion into the opposite ends of a folded length of loop material which is to form a button or decorative loop.

In the embodiment illustrated, the resilient handle is in the form of a U-shaped strip 48 of resilient metal or plastic the terminal ends of which are joined one to the rearward end of each of the pair of wire rods 50. The rods thus project forwardly from the handle in a direction perpendicular to the plane of the handle. The rods may be moved together, from the relaxed condition of the tool illustrated in FIGS. **5*a* and 6*a* to the position illustrated in FIGS. 5*b* and 6*b***, by squeezing inwardly on the outer sides of the U-shaped handle, as will be apparent.

In the use of the tool for forming button loops, a length of everted loop material L is installed on the outer end portions of the rods 50 by slipping the opposite ends of the loop material over the rods while the latter are in the relaxed, spread-apart condition illustrated in FIGS. **5*a* and 6*a*. The rods then are drawn together, to the position illustrated in FIGS. 5*b* and 6*b*, whereupon the terminal end portions of the loop material are brought together, or nearly so, so that the remaining portion of the material forms the button loop. The size of the button loop then may be adjusted by extending or retracting the loop material relative to the rods while positioning the assembly over the lined plate 10 illustrated in FIG. 1**, but out of contact with the adhesive surface of the tape T supported on the plate, and adjusting the loop material on the rods until the desired button loop size is achieved.

Having thus formed the desired button loop size, and while squeezing inward on the handle 48 to maintain the terminal end portions of the loop material close to each other, the tool with supported button loop is moved into proper position over the plate 10 in FIG. 1, with the loop aligned on the selected space marking 36 and with the rearward, closed end of the loop material registering with the selected loop size indicator line 40 or abutting the registering front edge of the straight edge bar 42, if employed. The tool now is moved downward until the terminal end portions of the loop material are brought in contact with the upwardly facing adhesive surface of the adhesive tape T. A finger of the hand not holding the handle 48 then is pressed down upon the terminal end portions of the loop material L while simultaneously withdrawing the rods 50 to release the tool.

The foregoing procedure is repeated until all of the lengths of loop material, folded and sized appropriately to form the desired button loops, are secured in properly spaced relationship along the length of the adhesive tape.

With the row of button loops thus secured to the length of adhesive tape, the end clip 30 is withdrawn and pulled free of the adhesive tape and said end of the tape gripped between fingers of one hand. The anchor block 22 with secured adhesive tape is withdrawn from the post 16, and the length of adhesive tape inverted so that the adhesive surface now faces downward. The adhesive strip, with secured button loops, then is placed upon the desired piece of garment fabric in the position desired for the button loops, and the adhesive tape pressed downward onto said fabric to secure the strip in position, with the button loops facing inwardly away from the adjacent edge of the fabric. A second piece of the garment fabric then is laid over the button loops and tape, with its adjacent edge preferably aligned with the corresponding edge of the underlying fabric, and the assembly then passed through a sewing machine so as to form a line of thread stitching along a line immediately adjacent the inner edge of the adhesive tape, i.e. along a line which corresponds to the stitching indicator line 38 on the plate 10. The button loops thus are secured firmly between both sheets of the garment fabric.

As previously explained, both sheets of garment fabric then are folded reversely, back over the line of stitching, in the direction opposite the extending button loops, whereby the latter are exposed between two folded edges of garment fabric.

The size of the button loop is determined by the space between the inner side of the closed, intermediate portion of the loop material L and the line of stitching.

The use of the tool in forming decorative loops is similar to the foregoing procedure, with the exception that the loops ordinarily are made more open. Thus, referring to FIGS. 7 and 8, the handle 48 may be retained in its relaxed condition, or contracted, or expanded, as desired, to provide the desired spacing between the rods 50. In this manner the loops L are given the desired shape and dimensions, after which they are secured to the adhesive surface of the tape T, in desired lateral spacings. The attachment of the array of loops to garment fabric is the same as described hereinbefore.

Figure 8:
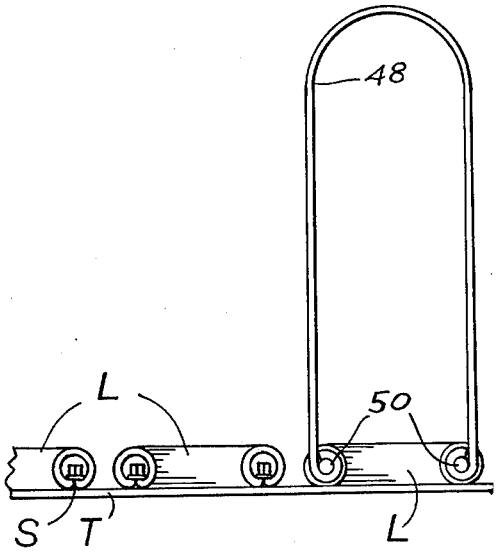
FIG. 8 is a fragmentary vertical elevation as viewed from the bottom in FIG. 7.

It it to be noted from FIG. 8 of the drawings that the loop holding tool affords the advantage of allowing the everted loop material to be rotated on the rods 50 so that the seam S is faced downward against the tape T. Thus, the seam is located against the fabric in the finished garment and thus its exposure to view is minimized.

From the foregoing, it will be appreciated that the present invention provides novel apparatus of simplified and economical construction by which to facilitate the formation and setting of a plurality of fabric button or decorative loops for integration into a fabric garment. The apparatus insures the formation of loops of precise and reproducible sizes with uniform spacings between them.

It will be apparent to those skilled in the art that various changes may be made in the size, shape, type, number and arrangement of parts described hereinbefore without departing from the spirit of this invention.

Having now described my invention and the manner in which it may be used, I claim:

1. Apparatus for securing a plurality of fabric loops of folded, everted fabric loop material at predetermined spaced-apart positions on an elongated strip of adhesive tape preliminary to transfer of the tape and secured loops to garment material for attachment of the loops to said garment material, the apparatus comprising:

(a) a laterally elongated plate having a transversely extending straight front edge, (b) a transversely extending elongated stitching line indicator on the plate rearwardly of and parallel to the front edge of the plate, (c) the laterally elongated area between the front edge and stitching line indicator defining a support area for an enlongated strip of adhesive tape, (d) a pair of adhesive tape anchors on the plate arranged to secure the opposite ends of an elongated strip of adhesive tape removably to said support area of the plate, with the adhesive surface of the tape facing upward, and (e) a transversely extending elongated loop size guide on the plate rearwardly of and parallel to the stitching line indicator for registering with said guide the closed ends of a plurality of said fabric loops of everted folded fabric loop material for indicating the size of fabric loops extending between the guide and stitching line indicator.

2. The apparatus of claim 1 including transversely spaced markings on the plate adjacent the front edge thereof for indicating the spacing between adjacent fabric loops on the plate.

3. The apparatus of claim 1 wherein at least one of the tape anchors includes a post secured to and extending upwardly from the plate, and an apertured anchor member adapted for removable attachment to the post, the bottom surface of the anchor member being adapted for attachment to the adhesive surface of an end portion of a length of pressure sensitive adhesive tape.

4. The apparatus of claim 3 wherein the post is of magnetic material and the apertured anchor member is a permanent magnet.

5. The apparatus of claim 1 wherein at least one of the tape anchors comprises a resilient clip member arranged to engage spaced edges on the plate and to overlie adhesive tape on the tape support area.

6. The apparatus of claim 1 wherein the loop size comprises a plurality of lines on the plate spaced apart rearwardly of and parallel to the stitching line indicator.

7. The apparatus of claim 1 wherein the loop size guide includes a straight edge member secured adjustably to the plate for adjustment of its straight edge parallel to and toward and away from the stitching line indicator.

8. The apparatus of claim 1 including:

(a) transversely spaced markings on the plate adjacent the front edge thereof for indicating the spacing between adjacent fabric loops on the plate, (b) a pair of tape anchors mounted removably on the plate for securing a length of pressure sensitive adhesive tape removably on the tape support area with the adhesive surface of the tape facing upward, one of the tape anchors including a magnetic member secured to the plate, and a permanent magnet adapted for removable attachment to the magnetic member by magnetic attraction, the bottom surface of the magnet being adapted for attachment to the adhesive surface of an end portion of a length of pressure sensitive adhesive tape, the other of the tape anchors comprising a resilient clip member arranged to engage spaced edges on the plate and to overlie adhesive tape on the tape support area, (c) and wherein the loop size guide comprises a plurality of lines on the plate spaced apart rearwardly of and parallel to the stitching indicator line.

9. The apparatus of claim 1 including a tool for supporting everted fabric loop material in folded form for application to a length of adhesive tape on the tape support area of the plate, the tool comprising a handle member having a pair of laterally spaced end portions movable toward and away from and parallel to each other, and a pair of parallel rods secured one to each of the handle end portions and projecting forwardly therefrom for entrance into the opposite terminal end portions of a folded length of everted fabric loop material.

10. The apparatus of claim 9 wherein the handle comprises a U-shaped length of resilient material.

11. A tool for supporting everted fabric loop material in folded form for application to a length of adhesive tape, comprising a handle member having a pair of laterally spaced end portions movable toward and away from and parallel to each other, and a pair of parallel rods secured one to each of the handle end portions and projecting forwardly therefrom for entrance into the opposite terminal end portions of a folded length of everted fabric loop material.

12. The tool of claim 11 wherein the handle member comprises a U-shaped length of resilient material.

* * * * *

UNITED STATES PATENT AND TRADEMARK OFFICE

CERTIFICATE OF CORRECTION

PATENT NO. : 4,212,698

DATED : 15 July 1980

INVENTOR(S) : Thomas O. Blair

It is certified that error appears in the above-identified patent and that said Letters Patent are hereby corrected as shown below:

Column 6, line 42, after " size " insert --guide--.

Signed and Sealed this

*Fourth* Day of *November 1980*

[SEAL]

*Attest:*

SIDNEY A. DIAMOND

*Attesting Officer*

*Commissioner of Patents and Trademarks*